US005620119A

United States Patent [19]

Keller

[11] Patent Number: 5,620,119

[45] Date of Patent: Apr. 15, 1997

[54] UMBRELLA HOLDER

[76] Inventor: Richard L. Keller, 6016 Chowen Ave. South, Edina, Minn. 55410

[21] Appl. No.: 467,746

[22] Filed: Jun. 6, 1995

[51] Int. Cl.[6] ..... A45B 11/02

[52] U.S. Cl. ..... 224/190; 224/186; 224/907; 135/20.1

[58] Field of Search ..... 224/186, 187, 224/188, 189, 190, 915, 642, 644, 251, 907; 135/20.1

[56] References Cited

U.S. PATENT DOCUMENTS

| | | | |
|---|---|---|---|
| 171,967 | 1/1876 | Arnold | 224/189 |
| 191,782 | 6/1877 | Smith, Sr. | 224/190 |
| 606,398 | 6/1898 | Stuckey | 224/190 |
| 702,398 | 6/1902 | Bowyer . | |
| 725,069 | 4/1903 | Gill | 135/20.1 |
| 738,554 | 9/1903 | Lingel | 135/20.1 |
| 853,397 | 5/1907 | Butler | 224/190 |
| 1,262,402 | 4/1918 | Stuckey | 224/190 |
| 1,347,540 | 7/1920 | Godard | 224/190 |
| 2,085,984 | 7/1937 | Kruithof | 224/188 |
| 2,926,826 | 3/1960 | Conrad . | |
| 3,120,332 | 2/1964 | White | 224/189 |
| 3,204,650 | 9/1965 | Shinew | 224/190 |
| 3,526,238 | 9/1970 | Brayton . | |
| 3,935,874 | 2/1976 | Cohen . | |
| 4,112,957 | 9/1978 | Biven | 224/190 |
| 4,261,494 | 4/1981 | Thomas . | |
| 4,558,807 | 12/1985 | Jackson . | |
| 4,657,037 | 4/1987 | Garrido et al. | 224/190 |
| 5,086,797 | 2/1992 | Earnshaw et al. | 135/20.1 |
| 5,263,837 | 11/1993 | Dompe | 224/190 |

FOREIGN PATENT DOCUMENTS

| | | | |
|---|---|---|---|
| 1557379 | 7/1967 | Germany | 135/20.1 |
| 56947 | 11/1911 | Switzerland | 224/190 |

*Primary Examiner*—Henry J. Recla
*Assistant Examiner*—Gregory M. Vidovich
*Attorney, Agent, or Firm*—Merchant, Gould, Smith, Edell, Welter & Schmidt, Professional Association

[57] ABSTRACT

A holder for carrying an open umbrella on the back of a person. The umbrella holder includes a harness for securing the holder to the person and an umbrella supporting member. The supporting member is connected to the harness so as to position the umbrella proximate a center of the back of the person when the harness is appropriately secured. An attachment member permits attachment of the open umbrella to the supporting member. The attachment member optionally permits pivotal movement of the umbrella for optimum protection.

10 Claims, 3 Drawing Sheets

UMBRELLA HOLDER

FIELD OF THE INVENTION

This invention relates generally to an umbrella holder. More specifically, this invention relates to an umbrella holder for carrying an open umbrella on the back of a person.

BACKGROUND OF THE INVENTION

The umbrella is one of the more practical inventions known to mankind and has been used for many centuries. In addition to providing shelter from the rain, it is also used for protection from the increasingly dangerous rays of the sun. Although the umbrella is a very efficient device for shielding and protecting us, it has one major drawback—it requires the user to hold the umbrella with their hand or hands. This can be particularly inconvenient when the user needs their hands free to hold other things, such as a briefcase, a purse, groceries, or a dog leash.

Devices are known which are designed to make carrying a closed umbrella more convenient. Examples include U.S. Pat. Nos. 4,558,807, 4,261,494 and 702,398. Such devices typically include a sheath or other embracing member for holding the closed umbrella, and a strap or belt for carrying the umbrella on a shoulder or the waist of the user.

At least one device is also known for carrying an open umbrella on a person without use of the hands. U.S. Pat. No. 2,926,826 discloses such a device. In this arrangement, a complex adjustable harness is worn on the shoulders of the user. Although the device is designed to hold a closed umbrella on the back of the harness, it only provides for holding an open umbrella on the front of the user. Moreover, the supporting member is off to the side, attached to one of the shoulder straps. This arrangement has certain disadvantages, including interference with the head rotation and visual range of the user, and poor coverage due to its off-center position.

What has been needed is a simple holder for carrying an open umbrella on a person, which is constructed to position the umbrella so that the user will have optimal protection from the elements.

SUMMARY OF THE INVENTION

According to the present invention, an umbrella holder for carrying an open umbrella on a person is provided.

In one aspect of the invention, the umbrella holder comprises a harness for securing the holder to the person. An umbrella supporting member is connected to the harness such that the supporting member is positioned proximate a center of the back of a person when the harness is appropriately secured to the person. An attachment member is designed to attach a shaft of the open umbrella to the supporting member.

In another aspect of the invention, the umbrella holder includes a mechanism for securing the holder to a person. An umbrella supporting member is connected to the securing mechanism and is positioned at generally about a center of the back of a person when the securing mechanism is appropriately secured to the person. An attachment mechanism permits attaching the umbrella to the supporting member.

These and other advantages and features of novelty which characterize the invention are pointed out with particularity in the claims annexed hereto. However, for a better understanding of the invention and its advantages, reference should be made to the drawings which form a further part hereof, and to the accompanying descriptive matter in which there is illustrated and described a preferred embodiment of the invention.

DETAILED DESCRIPTION OF THE PREFERRED EMBODIMENT

Figure 1:
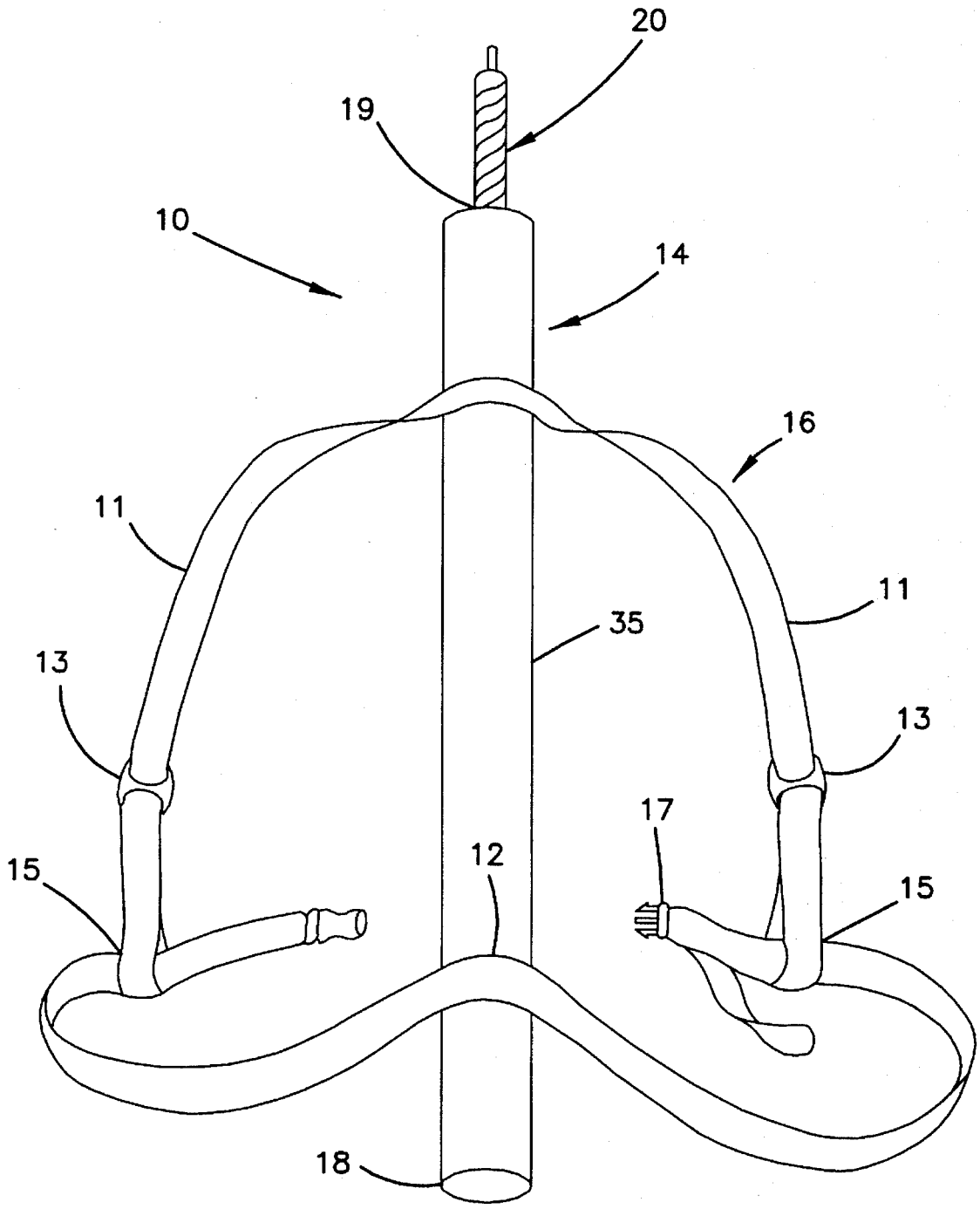
FIG. 1 is a back view of an umbrella holder according to the present invention.

Referring now to the drawings, wherein like numerals designate like parts, an umbrella holder 10 for carrying an open umbrella on a person is shown in FIGS. 1–4.

Referring to FIG. 1, umbrella holder 10 includes umbrella supporting member 14 and harness 16 for securing holder 10 to a person. Harness 16 and supporting member 14 are constructed and arranged such that supporting member 14 is positioned proximate the center of the back of a person. This positioning is advantageous because it provides optimum coverage for the person, while minimizing interference with arm and head movement. It will be appreciated that harness 16 and supporting member 14 could be designed in a variety of different ways so as to position the umbrella near the center of a person's back.

In the preferred arrangement, harness 16 includes a continuous strap extending to form shoulder straps 11 and a waist belt 12 extending through loops 15 at the bottom end of shoulder straps 11. Snaps or a hook and pile arrangement could be optionally employed to hold loops 15 closed above waist belt 12 The height of supporting member 14 is adjustable as appropriate for a particular person by moving height adjusters 13 on shoulder straps 11. It will be appreciated that the height of supporting member 14 could be adjusted in a number of other ways.

Waist belt 12 and the strap which forms shoulder straps 11 are attached to supporting member 14 by use of a hook and pile arrangement. Alternatively, vertical hook or pile strip(s) on supporting member 14 could permit further vertical adjustment of supporting member 14 relative to harness 16. Straps 11,12 are nylon, but other suitable materials could be used as well.

Umbrella holder 10 is secured to a person by positioning shoulder straps over the shoulders and on the front side of the person, and buckling waist belt 12 around the waist of the person with buckle 17. When shoulder straps 11 and waist belt 12 are appropriately adjusted, supporting member 14 should be aligned with the spinal column of the person, with its bottom end proximate the base of the backbone of the person.

Figure 3:
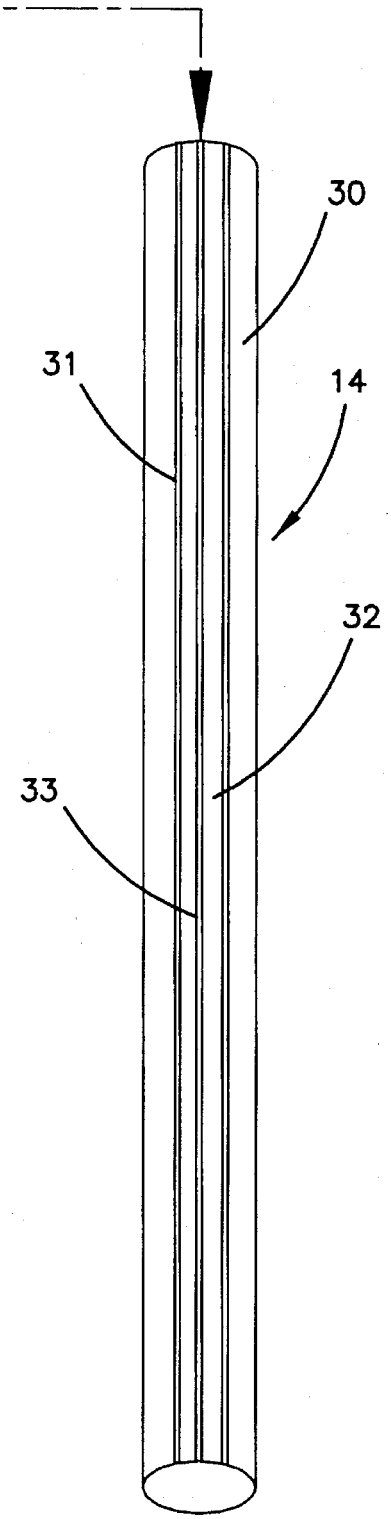
FIG. 3 is a supporting member according to the present invention.

Referring to FIG. 3, the preferred supporting member is an elongated sheath 14 arrangement comprising three concentric sleeves, including a slotted inner plastic pipe 32, a cardboard liner 31 with a slot corresponding to slot 33, and a soft foam outer layer 30 to provide padding. Vinyl cover 35 covers foam layer 30, and end caps 18,19 enclose the two ends of sheath 14. Plastic pipe 32 ("PVC" pipe in the preferred embodiment) provides a rigid inner member for stability, while soft foam layer 30 provides a padded outer member for comfort. Sheath 14 is approximately 28 inches in length to provide stability by bracing against the back of the person.

It will be understood that a variety of other arrangements could be employed to provide the preferred rigid inner and soft outer members. For example, a wood dowel could be employed as the inner member, with a pivotal arrangement or umbrella shaft connected directly thereto at its upper end.

Figure 2:
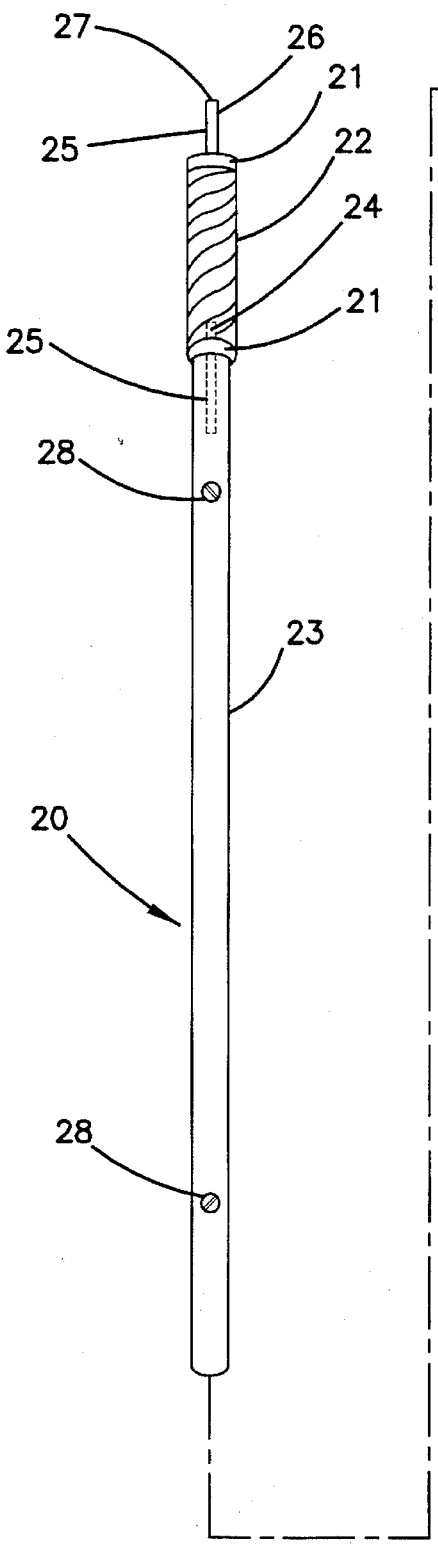
FIG. 2 is an attachment member according to the present invention.

Referring to FIG. 2, attachment member 20 includes flexible gooseneck 22 connected to fiberglass tube 23. Gooseneck 22 permits pivotal movement of the umbrella relative to the person. This allows the umbrella to be positioned for optimal protection from the elements. It will be appreciated that such pivotal movement could be accomplished with a number of other arrangements, such as a ball and socket type pivot.

Gooseneck 22 is connected to tube 23 by brass adapter 24, which threads into the bottom of gooseneck 22. Head cap screws 25 are threaded into the top of gooseneck 22 and adapter 24 at the bottom of gooseneck 22. Rubber washers 21 are provided between cap screw 25 and gooseneck 22 at the top and between adapter 24 and gooseneck 22 at the bottom. Heat shrinkable tubing 26 is heat shrunk onto screws 25 to provide a friction fit with fiberglass tube 23 and shaft 41 of umbrella 40 (see FIG. 4). Tube 23 includes aligned screws 28. When attachment member 20 is properly inserted into supporting member 14, screws 28 extend into slots 33 of pipe 32 and liner 31, thereby preventing rotation of attachment member 20 relative to supporting member 14. Top cap 19 of supporting member 14 includes a hole with a notch (not shown) for receiving tube 23 and screws 28. A set screw or the like can optionally be used to hold attachment member 20 in supporting member 14.

In the preferred design, shaft 41 of umbrella 40 must be cut to an appropriate size (see FIG. 4) to accommodate the construction of attachment member 20. The cut shaft 41 is then friction fit onto post 27. Attachment member 20 could also be connected to shaft 41 with a spring-loaded snap fitting on attachment member 20 and corresponding notch(es) on shaft 41. Another possible connection arrangement employs a sleeve on attachment member 20 which slides over shaft 41 and has an aperture positioned such that the spring-loaded umbrella retraction button extends therethrough to lock the umbrella in place.

In the alternative, sheath 14 could be constructed to receive and hold an uncut umbrella shaft. Also, sheath 14 could be constructed to universally hold umbrella shafts and/or handles of various shapes and sizes.

Figure 4:
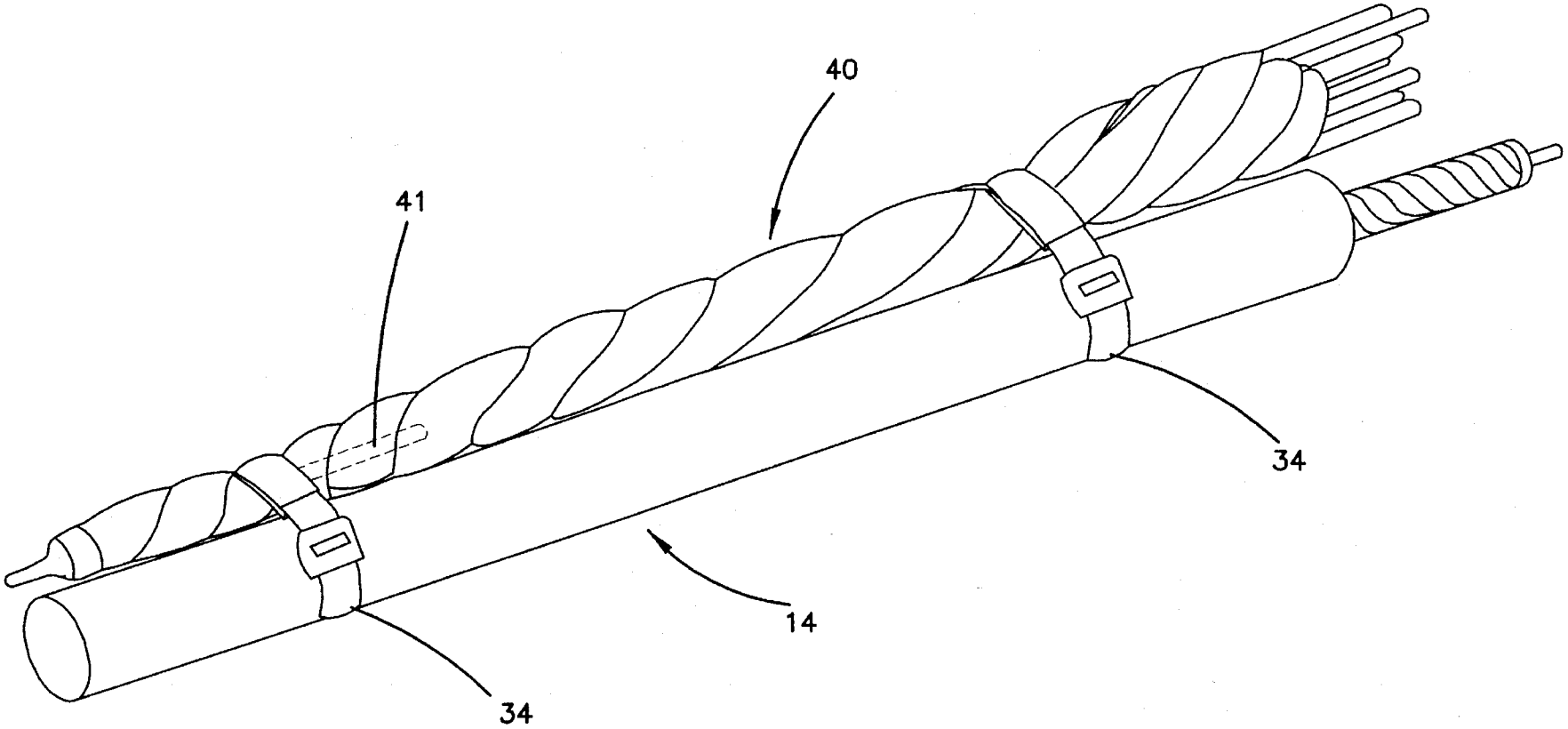
FIG. 4 is an umbrella holder according to the present invention (harness not shown), with a closed umbrella attached thereto.

Referring to FIG. 4, when umbrella 40 is not in use, the closed umbrella 40 can be carried on the person's back for convenience. Attachment straps 34 for attaching the closed umbrella 40 to sheath 14 are provided for this purpose.

It should be understood that the present invention is not limited to the preferred embodiment discussed above, which is illustrative only. Changes may be made in detail, especially in matters of shape, size, arrangement of parts, or material of components within the principles of the invention, to the full extent indicated by the broad general meanings of the terms in which the appended claims are expressed.

What is claimed is:

1. A holder for carrying an open umbrella on a person comprising:

(a) a harness for securing the holder to the person;

(b) an umbrella supporting member connected to said harness such that said supporting member is positioned proximate a center of a back of the person when said harness is appropriately secured to the person;

(c) said supporting member comprising an elongated sheath positioned substantially vertically along the center of the back of the person, said sheath including a rigid inner member extending at least from proximate the waist of the person to at least proximate the upper back of the person, and a soft padded outer member circumscribing said rigid inner member on at least a substantial portion of the length of said rigid inner member, such that said padded outer member provides cushioning between said rigid inner member and the back of the person; and (d) an attachment member for attaching a shaft of the open umbrella to said supporting member.

2. A holder according to claim 1, wherein said attachment member is pivotally movable so as to permit the umbrella to be positioned at various angles relative to the person.

3. A holder according to claim 2, wherein said attachment member comprises a flexible gooseneck.

4. A holder according to claim 1, wherein said harness is adjustable to change a height of said supporting member and the umbrella relative to the person.

5. A holder according to claim 4, wherein said harness includes two adjustable shoulder straps and a waist belt.

6. An umbrella holder according to claim 1, wherein a bottom end of said supporting member can be positioned so as to extend to a base of a backbone of the person.

7. An umbrella holder comprising:

(a) securing means for securing the umbrella holder to a person;

(b) an umbrella supporting member connected to said securing means and positioned generally about a center of a back of the person when said securing means is appropriately secured to the person;

(c) said supporting member comprising an elongated sheath positioned substantially vertically along the center of the back of the person, said sheath including a rigid inner member extending at least from proximate the waist of the person to at least proximate the upper back of the person, and a soft padded outer member circumscribing said rigid inner member on at least a substantial portion of the length of said rigid inner member, such that said padded outer member provides cushioning between said rigid inner member and the back of the person; and (d) attachment means for attaching an umbrella to said supporting member.

8. An umbrella holder according to claim 7, wherein said attachment means includes pivotal movement means for permitting the umbrella to be positioned at various angles relative to the person.

9. An umbrella holder according to claim 8, wherein said pivotal movement means comprises a flexible gooseneck.

10. An umbrella holder according to claim 7, wherein a bottom end of said supporting member can be positioned so as to extend to a base of a backbone of the person.

* * * * *